US010086918B2

(12) United States Patent
Pepper et al.

(10) Patent No.: US 10,086,918 B2
(45) Date of Patent: Oct. 2, 2018

(54) INFLATABLE WATERCRAFT STRUCTURES AND METHOD OF MAKING THE SAME

(71) Applicants: Stephen Pepper, Bayside, CA (US); Jonathan Speaker, Trinidad, CA (US)

(72) Inventors: Stephen Pepper, Bayside, CA (US); Jonathan Speaker, Trinidad, CA (US)

( * ) Notice: Subject to any disclaimer, the term of this patent is extended or adjusted under 35 U.S.C. 154(b) by 101 days.

(21) Appl. No.: 15/405,144

(22) Filed: Jan. 12, 2017

(65) Prior Publication Data

US 2017/0197691 A1 Jul. 13, 2017

Related U.S. Application Data

(60) Provisional application No. 62/277,740, filed on Jan. 12, 2016.

(51) Int. Cl.
*B63B 7/08* (2006.01)
*B63B 35/79* (2006.01)

(52) U.S. Cl.
CPC ..... *B63B 35/7913* (2013.01); *B63B 7/08* (2013.01); *B63B 35/793* (2013.01);
(Continued)

(58) Field of Classification Search
CPC B63B 7/08; B63B 7/082; B63B 7/085; B63B 35/793; B63B 35/7909; B63B 35/7913; B63B 2231/40; B63B 2221/18
(Continued)

(56) References Cited

U.S. PATENT DOCUMENTS 5,351,637 A 10/1994 Brenckmann
5,561,873 A 10/1996 Weedling
(Continued)

FOREIGN PATENT DOCUMENTS

FR 2602980 A1 * 2/1988 ..... B63B 35/7913
KR 101361081 2/2014
(Continued)

OTHER PUBLICATIONS http://www.towerpaddleboards.com. Best Stand Up Paddle Boards. [Retrieved on Dec. 8, 2015].
(Continued)

*Primary Examiner* — Ajay Vasudeva
(74) *Attorney, Agent, or Firm* — Craig M. Stainbrook; Stainbrook & Stainbrook, LLP

(57) ABSTRACT

An inflatable structure that includes continuous longitudinal and axial curves, constructed to form a hydrodynamically designed performance platform for use as a performance water sports board, rescue board, or rescue sled, such as a stand-up paddle board, paddleboard, surfboard, PWC rescue sled, bodyboard, or other floating or dynamic platform. Alternatively, it may be adapted for use with additional structure to provide an inflatable hull and floor for a watercraft, such as a boat, raft, life-raft, rescue craft, or other floating or dynamic platform. Longitudinal stringers welded to opposing panels defining the interior volume of the inflatable structure are joined by welding, gluing, or lashing, and the shape of the stringers and the welding/gluing/lashing schedule can be employed to give the inflatable structure a highly customized curved shape.

20 Claims, 10 Drawing Sheets

(52) U.S. Cl.
CPC ..... *B63B 35/7909* (2013.01); *B63B 2221/18* (2013.01); *B63B 2231/40* (2013.01)

(58) Field of Classification Search
USPC ..... 114/345; 441/40–42, 66; 5/615, 655.3, 5/681, 706, 708, 710–714
See application file for complete search history.

(56) References Cited

U.S. PATENT DOCUMENTS

| | | | | |
|---|---|---|---|---|
| 5,680,662 | A * | 10/1997 | Purdy | A47C 27/081 5/676 |
| 5,964,178 | A | 10/1999 | Gonda | |
| 6,860,220 | B2 | 3/2005 | Fleming | |
| 7,017,747 | B2 | 3/2006 | Kiger et al. | |
| 7,662,006 | B2 | 2/2010 | Mollis | |
| 7,985,111 | B2 | 7/2011 | Gasparro | |
| 8,146,184 | B2 * | 4/2012 | Lin | A47C 27/081 5/417 |
| 8,591,274 | B2 | 11/2013 | Haller et al. | |
| 8,656,855 | B2 | 2/2014 | Flood et al. | |
| 8,834,220 | B2 | 9/2014 | Haller et al. | |
| 9,616,977 | B2 * | 4/2017 | Kim | B63B 35/7906 |
| 9,694,540 | B2 * | 7/2017 | Trockel | B29C 67/0051 |
| 2003/0153221 | A1 | 8/2003 | Weir | |
| 2009/0049757 | A1 | 2/2009 | Potter | |
| 2014/0364022 | A1 | 12/2014 | Dingel | |
| 2015/0147926 | A1 | 5/2015 | Trockel | |

FOREIGN PATENT DOCUMENTS

| | | | | |
|---|---|---|---|---|
| KR | 101361081 | B1 * | 2/2014 | B63B 35/79 |
| WO | 2013175160 | | 11/2013 | |
| WO | WO-2013175160 | A1 * | 11/2013 | B63B 35/7913 |

OTHER PUBLICATIONS http://www.supgower.com/2013/07/fanatic-inflatable-sup. [Retrieved on Dec. 8, 2015].
http://ssboats.en.alibaba.com/products; CE Certification Hot Sale inflatable stand up paddle board/SUP board/ Air board surfing/ Rescue surf/ stand up paddle board. [Retrieved on Dec. 8, 2015].
http://www.advancedelements.com/stiffy.html. [Retrieved on Dec. 8, 2015].

* cited by examiner

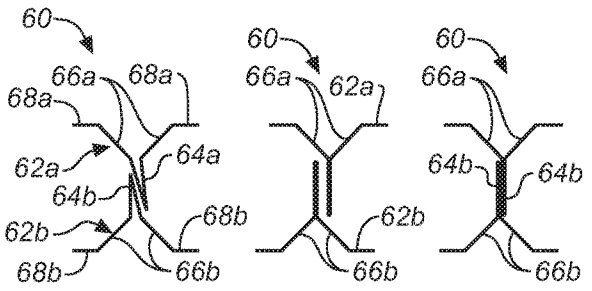
FIG. 6A
FIG. 6B
FIG. 6C
FIG. 7A
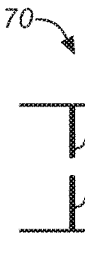
FIG. 7B
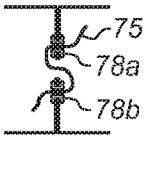
FIG. 7C
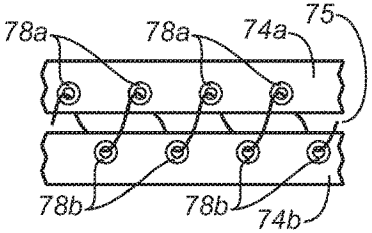
FIG. 7D
FIG. 8A
FIG. 8B
FIG. 8C
FIG. 9A
FIG. 9B
FIG. 9C
FIG. 9D

INFLATABLE WATERCRAFT STRUCTURES AND METHOD OF MAKING THE SAME

CROSS REFERENCES TO RELATED APPLICATIONS

The present application claims the benefit of the filing date of U.S. Provisional Patent Application Ser. No. 62/277,740, filed Jan. 12, 2016 (Jan. 12, 2016), which application is incorporated in its entirety by reference herein.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Field of the Invention

The invention relates most generally to watercraft, and more particularly to floatation structures for watercraft or comprising a sports board, and still more particularly to inflatable watercraft and/or watercraft parts, and methods of manufacturing the same.

Background Discussion

All of the known state of the art inflatable high pressure watersports boards are constructed with a drop-stitched PVC fabric. The manufactures number over 20. The drop stitch fabric includes two walls, and is therefore termed a "double wall fabric." It typically includes opposing and parallel PVC panels connected with thin and dense columns of tens of thousands of interwoven nylon stitches holding the panels in their opposing relationship. The stitching pattern can be varied so as to provide differing degrees of rigidity, but any degree of rigidity using any known pattern requires the introduction of high pressure into the closed volume defined by the panels. Pressures over 30 psi are possible, and pressures of 15-25 psi are common, but more importantly, they are needed to provide the board with any meaningful degree of rigidity, particularly when the article is embodiment as a watercraft such as a stand-up paddle board.

To call these boards "high performance" boards, however, would be hyperbole; in truth, their very modest performance characteristics warrant classifying them in a dramatically subordinate, stepped down position from the solid boards. This is due both to the lack of shear strength in the boards, making them prone to collapse unless inflated to very high pressures, and to the fact that no meaningful rocker or other performance design characteristics (including various types of rail configurations) can be introduced using the drop stitch construction techniques. Performance design characteristics can only be minimally provided in a drop stitch board, because by the very nature of the fabric employed, the drop stitch resists rocker, and manufacturers must force minimal dimensional gains through side panels, resulting in "boxy" rails very unlike those in performance "hard boards" and the boards made possible by the present invention.

Accordingly, the very essence of good waterboard performance—namely, bottom rocker—cannot be included in a drop stitch board, let alone complex bottom rocker, such as nose rocker, tail rocker, and mid rocker. Likewise, there cannot be any upper curvature suitable for rider comfort and performance features. Disappointingly, drop stitch boards are flat and tend toward square. The flatness of the board is reflected in the flatness of the performance characteristics.

The foregoing discussion reflects the current state of the art of which the present inventors are aware. Reference to, and discussion of, the known products and manufacturing methods is intended to aid in discharging Applicants' acknowledged duty of candor in disclosing information that may be relevant to the examination of claims to the present invention. However, it is respectfully submitted that none of the known prior art products disclose, teach, suggest, show, or otherwise render obvious, either singly or when considered in combination, the invention described and claimed herein.

BRIEF SUMMARY OF THE INVENTION

The present invention represents a radical departure from the above-described commonly accepted materials and means of manufacturing inflatable watercraft, such as stand up paddle boards (SUP boards). Using the inventive materials and inventive fabrication techniques, high performance inflatable boards can be produced that possess the desirable performance characteristics of solid boards, including remarkable rigidity for an inflatable design, plus bottom rocker of all kinds—nose, tail, staged, continuous, and variations thereof, and performance rail designs such as pinched and ballooned rails, as well as others, and even changes in the rail type and thickness along the length of the board or watercraft. Upper deck shape and curvature is also achieved, including domed or dished shapes (i.e., convex or concave about several axes). This is achieved using a novel internal stringer system, constructed using a new inflatable board construction process. The internal stringers provide internal longitudinal sheer resistance that significantly increases rigidity and simultaneously reduces the necessary internal air pressure required for characteristics comparable to the rigid boards on the market. Several other advantages are realized by the present invention:

Internal (or recessed) fin boxes may be employed, similar to those found in hard boards, which are vastly superior to externally mounted fin bases on currently marketed inflatable boards, which increase drag by obstructing water flow across the bottom of the inflatable board. In an embodiment, the fin boxes are recessed, and in this configuration the fin boxes can be anchored to the opposing side of the board, thereby decreasing fin flex due to hydrodynamic pressures encountered in high performance conditions.

The use of chemically bonded urethane coatings provides a permanent extra layer of puncture, tear and abrasion resistance that also seals out water from wicking into the scrim at all of the exterior exposed edges of the assembled fabric panels.

Further, permanent, customized designs (both board shape and applied artwork) can be achieved for every individual board (just like custom shaped surfboard art).

The most salient improvements are attributable to a customizable internal longitudinal stringer system. Each internal stringer in the stringer system is longitudinally cut down its length and welded or glued to either the upper or lower board panel. It is then coupled to a complementary opposing stringer on the opposing panel, effectively creating a plurality of upper and lower stringers that are joined together. The upper and lower stringers may overlap a predetermined amount and the overlapping portions can be welded or glued together. Alternatively, the opposing upper and lower stringers can be zig-zag lashed together by parachute cord, from a single anchoring point in the nose or bow, and to a permanent anchor, or alternatively, to an individual winch mechanism in the tail or stern that allows a user to expand or decrease the thickness of the board based on user or environmental conditions. A lower profile board can be achieved for use in doing yoga, for instance, or a higher profile can be achieved for use in rough water conditions.

In an embodiment, the inventive inflatable panels of the present invention may be employed to make an inflatable boat hull, floor, or even an entire boat. The internal stringer system of the present invention is adaptable and suitable for use in producing innovative inflatable hulls and/or floors and/or sides for and of inflatable boats. This can yield a complete inflatable boat or, when fixed to a conventional inflatable boat solid transom, a complete performance inflatable boat. They may be shaped with complex curvature, as described above.

The foregoing summary broadly sets out the more important features of the present invention so that the detailed description that follows may be better understood, and so that the present contributions to the art may be better appreciated. There are additional features of the invention described in the detailed description of the preferred embodiments of the invention, which follows, below, and which form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein:

FIG. 6A is a highly schematic end view in elevation of upper and lower portions of a split base stringer with the medial flap portions in their pre-fabrication configuration;

FIG. 6B is the same view showing the upper and lower medial portions each welded into upper and lower medial flaps, respectively;

FIG. 6C is the same view showing the upper and lower medial flaps welded together to form a unitary stringer;

FIG. 7A is a highly schematic end view in elevation of upper and lower portions of a planar base stringer with the medial flap portions in their pre-fabrication configuration;

FIG. 7B is the same view showing the upper and lower medial portions each welded into upper and lower medial flaps, respectively;

FIG. 7C is the same view showing grommets installed in each of the upper and lower medial flaps and the flaps being lashed together with a lashing so as to form a unitary stringer;

FIG. 7D is a side view in elevation showing a portion of the stringer of FIG. 7C;

FIG. 8A is a highly schematic end view in elevation of upper and lower portions of a split base stringer with the medial flap portions in their pre-fabrication configuration;

FIG. 8B is the same view showing the upper and lower medial portions each welded into upper and lower medial flaps, respectively;

FIG. 8C is the same view showing grommets installed in each of the upper and lower medial flaps and the flaps being lashed together with a lashing so as to form a unitary stringer;

FIG. 9A is a highly schematic end view in elevation of upper and lower portions of a split base stringer with the medial flap portions in their pre-fabrication configuration and cordage disposed in the crotch of each of the upper and lower medial portions;

FIG. 9B is the same view showing the upper and lower medial portions each welded into upper and lower medial flaps, respectively, with the cordage secured within the weld at the edges of the upper and lower medial flaps;

FIG. 9C is the same view showing the flaps being lashed together with a lashing so as to form a unitary stringer;

FIG. 9D is a side view in elevation showing a portion of the stringer of FIG. 9C;

DETAILED DESCRIPTION OF THE INVENTION

Figure 1:
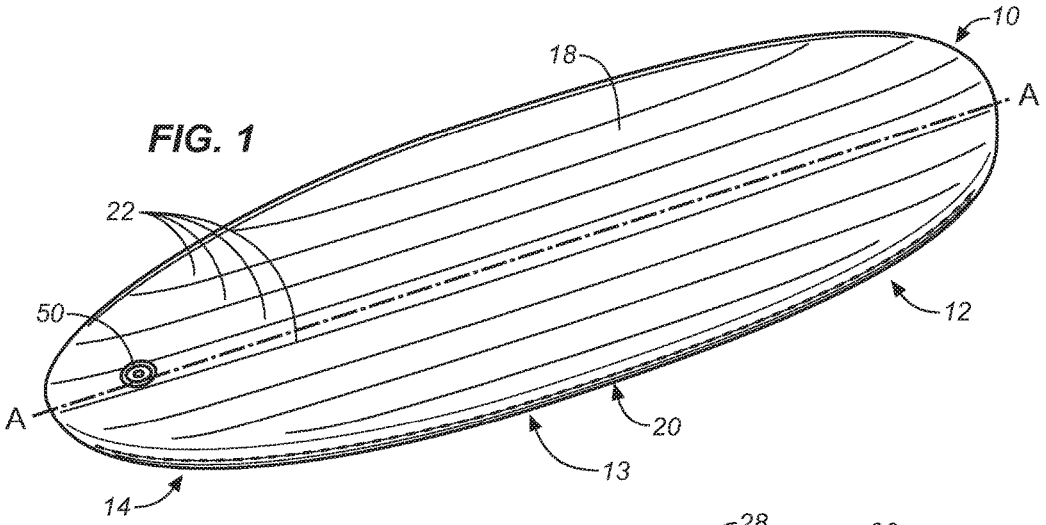
FIG. 1 is an upper right rear perspective view of a high performance water sport board constructed using the materials and inventive fabrication techniques of the present invention.

Referring initially to FIG. 1, we see that in an embodiment, the inflatable structure of the present invention can take the form of a water sport board 10. The board is shown with evident nose rocker 12 mid-rocker 13, and tail rocker 14. Also shown is nose and tail taper as the board thins closer to the ends (refer here to FIG. 4A), and rail shape 16, e.g., a tapered performance rail (referring to FIG. 3C). While the rail shape 16 is more subtle, it is clearly seen in FIG. 3C, and it will be appreciated that there are numerous rail shapes and bottom contours possible, including vee or concave.

The board is generally symmetrical right and left of its longitudinal axis A, and includes a top (first) flexible material panel ("upper panel" or "deck panel") 18 and a bottom (second) flexible material panel ("lower panel" or "bottom panel") 20. The panels are preferably made from very high quality coated fabric, for instance, a plastic-based polymer, such as the XR MARINER® fabric or other material from Seaman Corporation of Wooster, Ohio or comparably strong, waterproof, bondable polymeric material or composite material. [XR MARINER® is a registered trademark of Seaman Corporation.] A plurality of internal longitudinally oriented stringers 22 made of the same fabric are disposed between and affixed to the interior sides 24, 26 of the upper and lower panels, respectively.

In an embodiment, the stringers are paired inboard stringers 28 and outboard stringers 30 and symmetrically spaced about the longitudinal axis, thus entailing the use of an even number of stringers. Full scale water sports boards preferably have a total of eight (8) stringers disposed alongside the board centerline. The interior stringers (those closest to the centerline) each include an upper portion, 28*a*, 30*a*, for the upper portions of the inboard and outboard stringers, respectively, and 28*b*, 30*b* for the lower portions of the inboard and outboard stringers, respectively.

Figure 2A:
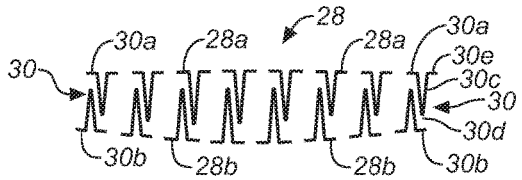
FIG. 2A is a highly schematic cross-sectional end view in elevation showing an embodiment of the longitudinal internal stringers used to provide shear strength in the present invention, the embodiment comprising a planar base stringers, and this view showing the upper and lower portions of the stringers in their pre-fabrication configuration.
Figure 2B:
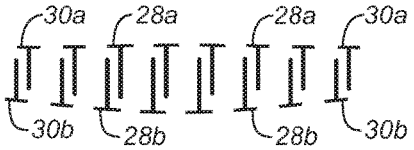
FIG. 2B is the same view showing the base portion of each of the upper and lower stringer portions welded to together to form overlapping upper and lower medial flaps.

In an embodiment, shown in FIGS. 2A-2B, wherein the stringers have planar bases and the upper and lower stringers are manufactured from a single panel of flexible material, the panels may be folded into a cross-sectional shape of a "V" or inverted "V". Using the outboard stringer as an example, it is seen that the stringer thus includes the two stems 30*c* (comparable to stem and arm), a crotch 30*d*, and the flanges or base portions 30*e* (comparable to outwardly extending serifs). In manufacture, the stems (FIG. 2A) are first welded together to form a single generally planar panel (FIG. 2B); then the base portions of the upper stringers are welded to the upper panel and the base portions of the lower stringers are welded to the lower panel. The stringers are oriented generally parallel to the longitudinal axis of the panels. Once affixed, the upper stringers present a medial flap extending downwardly from the interior side of the upper panel, and the lower stringers present a medial flap extending upwardly from the interior side of the lower panel. The medial flaps may overlap in a side-by-side arrangement or have edges slightly spaced apart, depending on whether the flaps are to be joined with a lashing (when the edges are separated) or a weld (when the flaps overlap).

Figure 3A:
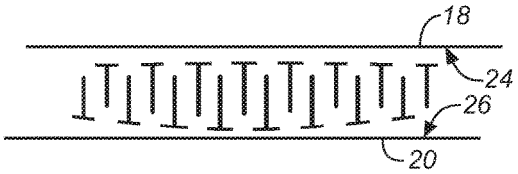
FIG. 3A is the same view showing upper and lower flexible material panels disposed above and below the stringers.
Figure 3B:
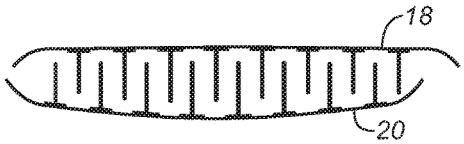
FIG. 3B shows the flexible material panels being folded at their sides to form overlapping edge portions.
Figure 3C:
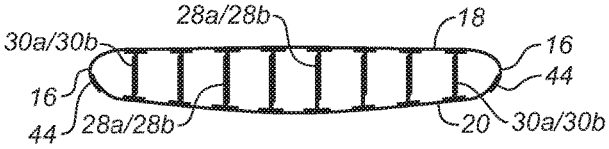
FIG. 3C shows the overlapping edge portions of the fabric panels welded to form a sealed side.
Figure 4A:
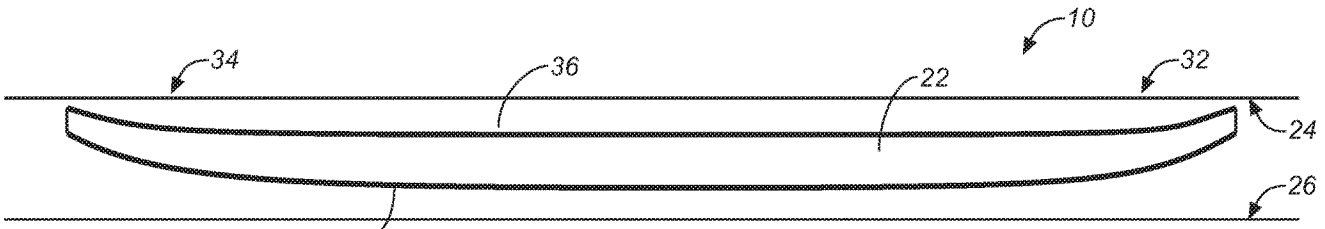
FIG. 4A is a highly schematic cross-sectional side view in elevation corresponding to FIG. 3A.
Figure 4B:
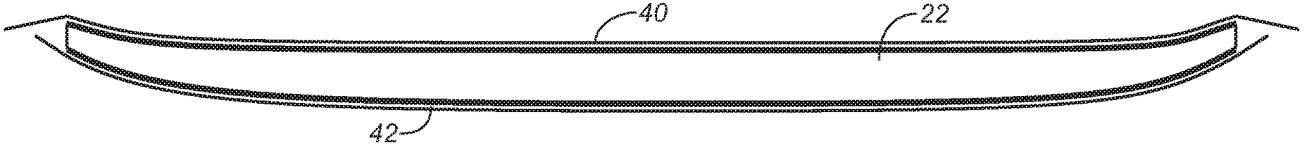
FIG. 4B is a schematic side view in elevation corresponding to FIG. 3C, showing the end portions of the flexible fabric panels being folded to form an overlapping portion.
Figure 4C:
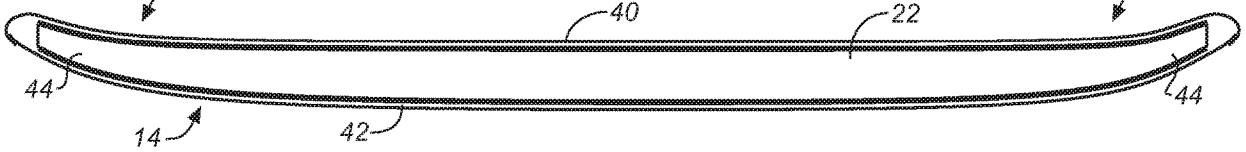
FIG. 4C, is a schematic side view in elevation showing the overlapping end portions joined in a welded seam.
Figure 5:
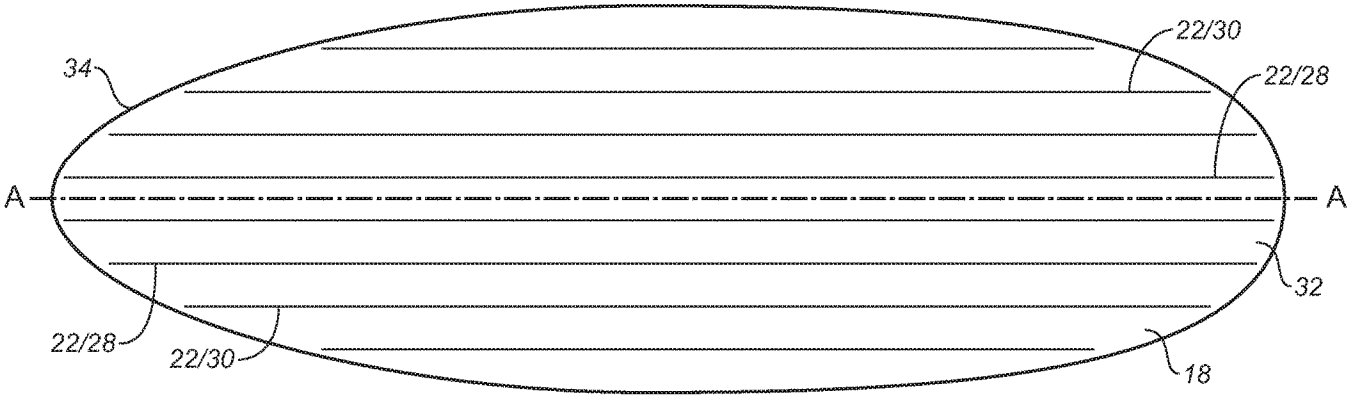
FIG. 5 is a top plan view of the board as formed and shown in FIG. 4C.

As can be seen in FIGS. 3A-3C, once the upper and lower portions of the stringers are coupled, the outboard stringers have a height less than that of the inboard stringers. Further, and referring now to FIGS. 3A through 3C and FIGS. 4A through 4C, it is seen that the stringers can, and preferably do, have upper and lower contours from the front end 32 to the rear end 34 of the inflatable board 10. These contours may include a continuous or staged concave upper curvature 36 and a continuous or staged lower curvature 38. The upper and lower contours can be, and preferably are, different from one another. When the upper and lower panels 18, 20 are welded to the flanges (base portions) 28*a*/28*b*, 30*a*/30*b* of the upper and lower stringers, because the paired inboard and outboard stringers are identical in their pairings, the panel surfaces are configured allochirally in their conformation to the shape dictated by the upper and lower stringers. Thus, in the exemplary views, the upper panel 18 is configured with a concave surface 40, and the lower panel 20 is configured with a convex surface 42.

Closure of the inflatable structure to form an airtight interior volume involves bending the sides and ends of the upper and lower fabric panels to create a continuous, surrounding seam 44 sealed with a high frequency, solvent, hot air, or ultrasonic weld, or glued with a suitable plastic adhesive. The entire floatation platform may be coated with chemically bonded urethane to increase its durability and provide artistic customization.

An air inlet/outlet (inflation/deflation) boat valve 50, such as a Boston or thwart valve, or preferably a C7 valve as manufactured by Leafield Marine, Ltd. of Wiltshire, UK, is inserted in the deck fabric along the longitudinal centerline A proximate the stringer terminations on each side of the centerline, or other locations. Thus, air under pressure can be pumped or fed into the inflatable board (or selectively released, as desired) to achieve high overall rigidity, and access can be provided for adjusting stringer tensions in a lashing embodiment. Working models of watersport boards have been demonstrated to provide high performance characteristics inflated with only low pressures, e.g., not exceeding 5 psi. The internal longitudinal stringers provide such superior shear strength that the board will have an overall rigidity and resistance to collapse around any axis, thus rivaling the structural characteristics of solid boards, and with a shear strength vastly exceeding that of drop stitch inflatable designs.

FIGS. 6A through 9D show alternative stringer configurations, each capable of achieving the above-described advantageous characteristics. Referring now to FIGS. 6A-6C there is shown in an end view in elevation, a highly schematic split base stringer 60 having upper and lower portions 62*a*/62*b* with medial flaps 64*a*/64*b* in their pre-fabrication configuration, and showing how two unattached fabric sections 66*a*/66*b* form the arms of a "Y" configuration viewed on end, while the bonded medial flap portions (see FIG. 6B) for the stem. The base portions 68*a*/68*b* of the upper and lower portions 62*a*/62*b* are welded or otherwise affixed to the upper and lower panel interior sides, as described above. In assembly they are then welded together to form the unitary longitudinal internal stringer (see FIG. 6C).

FIGS. 7A through 7D show yet another stringer configuration 70, this having the structural features of the planar base stringer described above, but having upper and lower portions 72*a*/72*b* with medial flap portions 74*a*/74*b* with troughs or crotches 76*a*/76*b* spaced apart when installed on the fabric panels. Grommets 78*a*/78*b* are installed in rows in the upper and lower medial flaps 74*a*/74*b* and a lashing 75 connects the upper and lower stringer portions by being threaded in a continuous serpentine pattern through the grommets extending from the front end of the stringer to the rear end (see FIG. 7D). The lashing is anchored at the front end of the stringer and secured for adjustment at the rear end.

FIGS. 8A-8C show yet another stringer configuration 80, this synthesizing the split base design shown in FIGS. 6A-6C with the lashing method of coupling the upper and lower stringer portions, as described in connection with FIGS. 7A-7D.

FIGS. 9A-9C show still another embodiment 90 of the longitudinal stringer of the present invention, this design also constituting a slight variation on the lashing design shown in FIGS. 7A-7D. Rather than using grommets, a durable cord 92*a*/92*b* (such as parachute cord) is placed in the troughs or crotches 94*a*/94*b* of the upper and lower medial flaps 96*a*/96*b*, and the medial portions are then welded or bonded so as to capture the cordage in a strong terminal line defining the edge of the medial flap. Apertures 98*a*/98*b* are then cut in rows immediately above the cordage so that a lashing 95 can be threaded in a continuous serpentine pattern through the apertures, in the manner described with respect to the use of grommets.

Figure 10A:
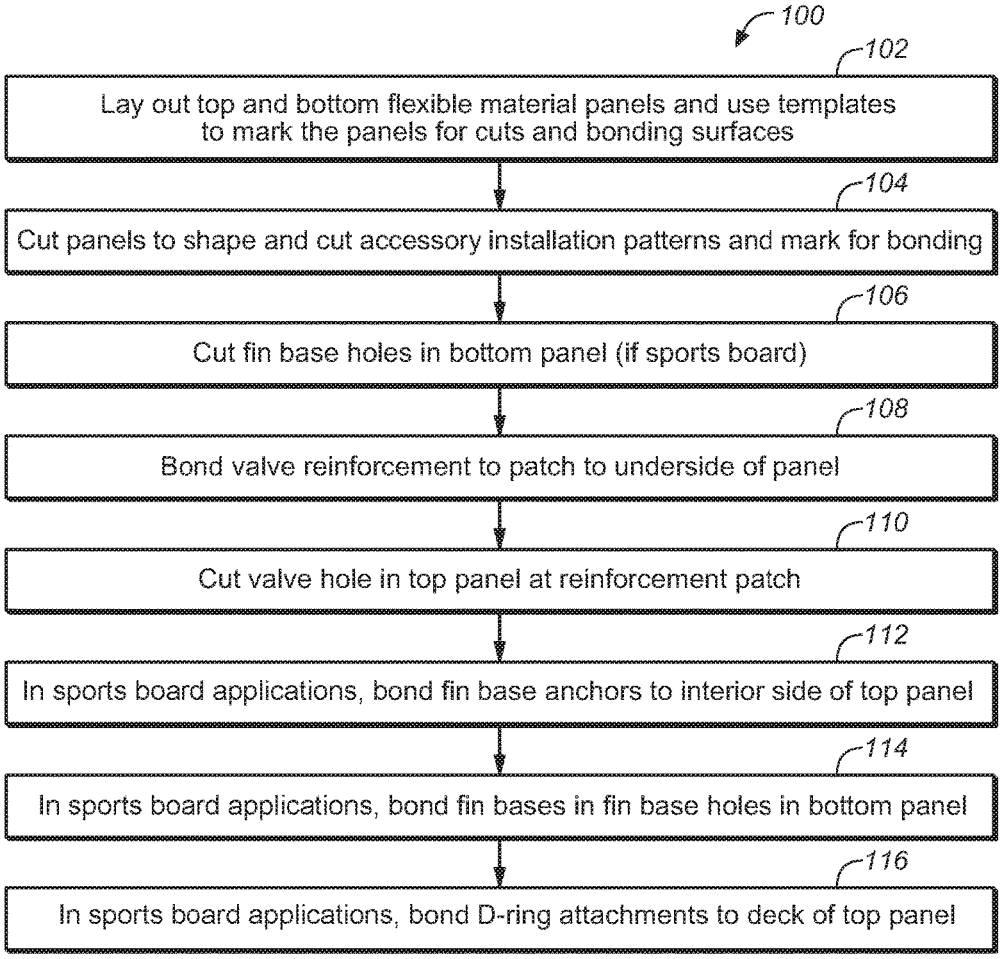
FIG. 10A is a flow chart showing the method steps employed in the pre-assembly portion of fabricating the inflatable structure of the present invention.
Figure 10B:
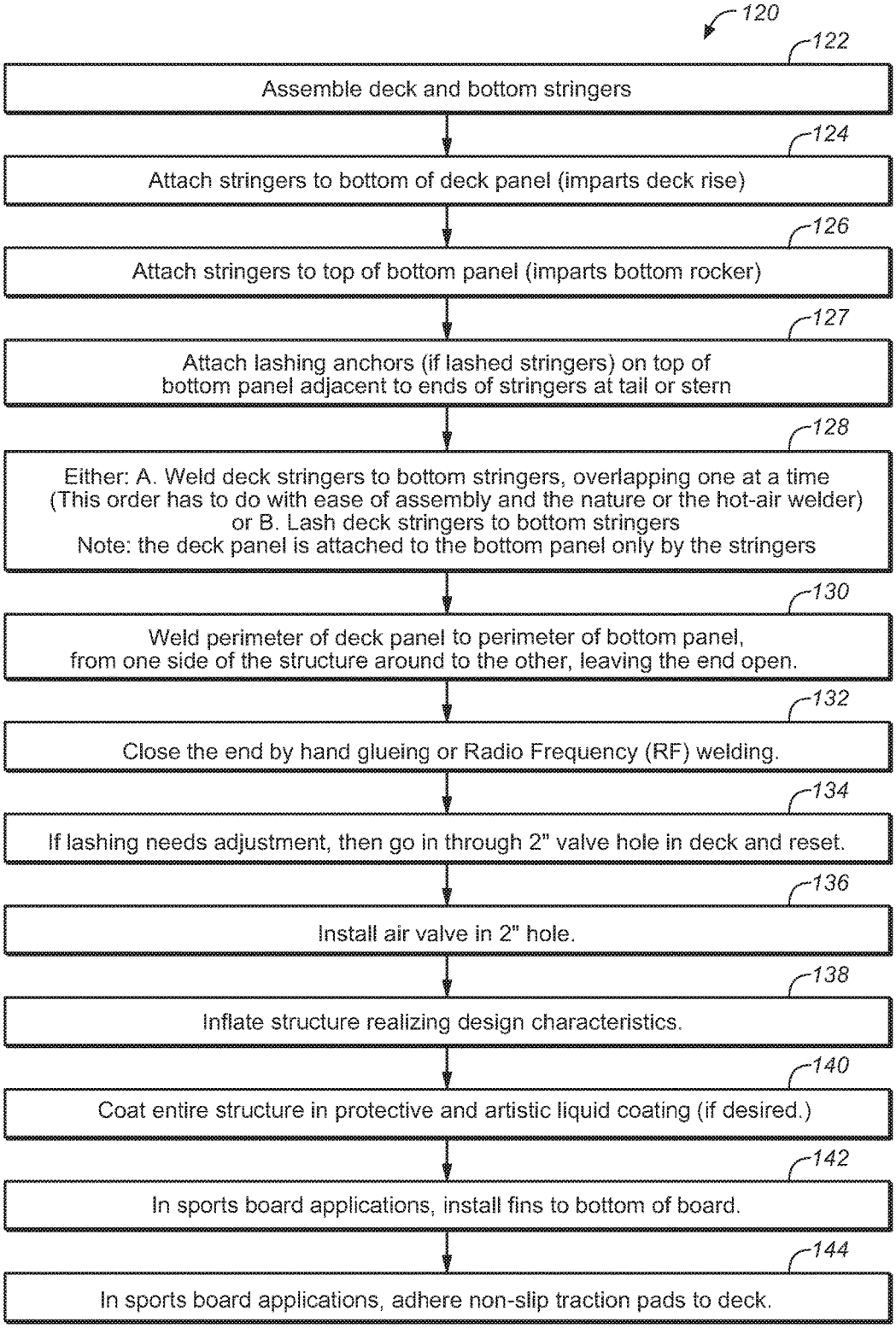
FIG. 10B is a flow chart showing the steps involved in the assembly method.

The method of manufacturing and assembling the inflatable structure of the present invention is also novel, making possible the inventive floatation structures. Referring to FIGS. 10A-10B, there is shown in flow chart form the essential method steps for preparing the structural elements for assembling and then of assembling the inventive inflatable structures. Referring now to FIG. 10A, pre-assembly 100 involves preparing the structural elements and begins by laying out the first and second flexible material panels (upper/top and lower/bottom, respectively) and using templates to mark the panels for cuts and bonding surfaces 102. The templates define whether the panels will be employed for a board, hull, boat bottom, or some other inflatable structure.

The panels are then cut to shape and further cut with accessory installation patterns 104, as called for by the final design. The panels are also marked for the bonding steps. If the inflatable structure is a sports board, fin base holes are cut in the bottom panel 106. A valve reinforcement patch is bonded, either by welding or gluing, to the underside (interior side) of the top panel 108, and a valve hole is cut into the top panel 110.

Again, if the inflatable structure is a sports board, injection molded fin base anchors are bonded to the interior side of the top panel 112, and injection molded fin bases are bonded in the fin base holes in the bottom panel 114. If a lashing arrangement is contemplated, D-ring attachments/anchors are then glued or welded to the bottom panel 114 at the front, nose, or bow, as well as the rear, tail, or stern.

Referring next to FIG. 10B, assembly 120 then begins by assembling the top and bottom stringers 122 by folding each stringer panel in half along its longitudinal axis, and then bonding the halves together. If the cordage/lashing approach is to be employed for connecting upper and lower stringer portions, the cordage is placed in the crotch of each portion before the medial flap portions are bonded together. The stringer flanges remain untouched to this point. This is repeated for all deck and bottom panel stringers until the stringers are assembled.

If grommets will be used for lashing, then grommet holes are punched and grommets installed. If cordage and lashing is to be employed, then apertures are punched above the cordage.

Next, the upper portions of the stringers are bonded to the bottom side of the deck/top panel 124. This imparts the deck contour to the top panel. The lower portions of the stringers are bonded to the top side of the bottom panel 126, and this imparts bottom rocker or bow/stern profile.

Next, if the upper and lower stringer portions are to be coupled using lashings, at step 127 lashing anchors are attached to the top of the bottom panel adjacent to the ends of the stringers at the tail or stern of the watercraft.

Then, depending on the method employed to connect the upper and lower stringer portions—lashing or welding—the upper/top stringer portions are either welded or lashed to the bottom stringer portions 128.

If the inflatable structure is to be a board, then fin bases are installed in fin base anchors at this point (not shown in the view).

The perimeter of the top panel is folded over and welded to the perimeter of the bottom panel from one side of the structure (or stern) to the other, leaving the center or end open 130. The end (e.g., the tail/stern) is then closed by hand gluing or welding 132.

If the stringer type involves lashing, then lashing adjustments can be made by accessing the interior of the board through the 2 inch valve hole and resetting the stringer D-ring anchor 134.

An air fill valve is then installed in the top panel hole 136. The structure (e.g., the board) is then inflated 138, at which point all of the shape, curvature, conformations, and design characteristics are fully expressed.

The structure may then be coated (though it need not be) with a protective and artistic liquid polyurethane 140. Fins are then installed 142. If the structure is a sports board, non-slip traction pads are installed on the deck 144. The structure is then ready for high performance use. It will be appreciated that fins can be swapped out at any time over the life of the board so as to take advantage of various fin shapes for different applications, and number of fins.

Figure 11A:
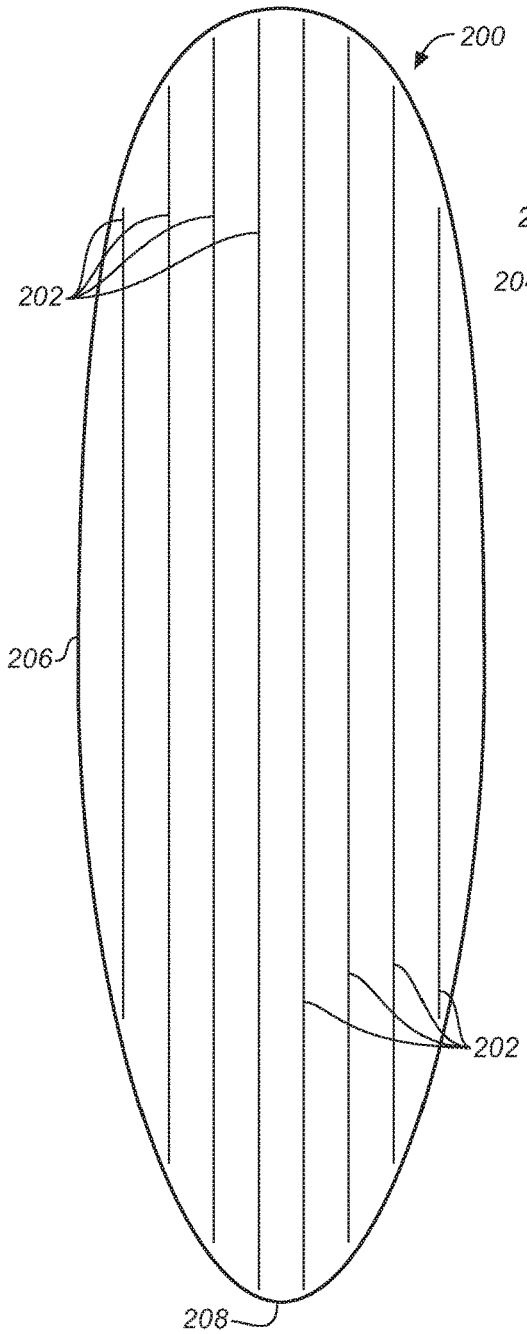
FIG. 11A is a top plan view of the inventive apparatus embodiment in a performance surfboard with a planing hull.
Figure 11B:
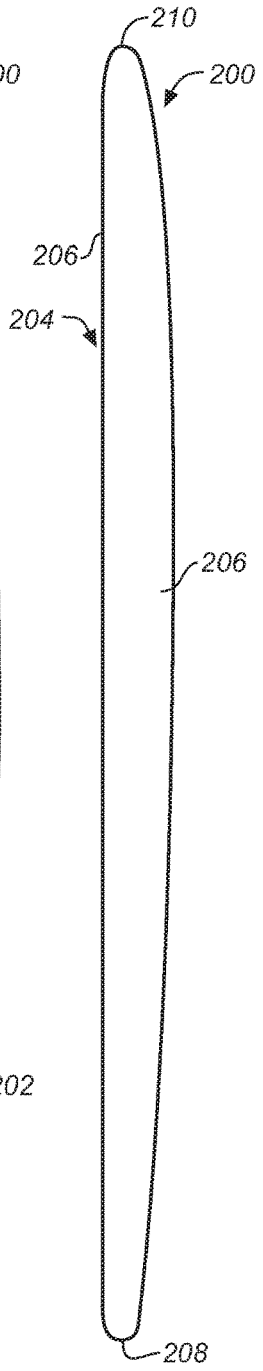
FIG. 11B is a side view in elevation thereof.
Figure 11C:
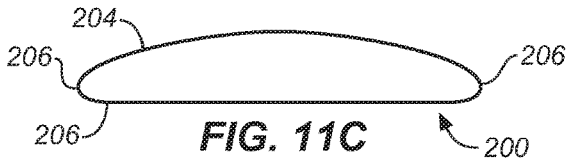
FIG. 11C is an end view in elevation thereof.

FIGS. 11A-11C show the inflatable watercraft structure of the present invention embodiment in a performance surfboard with a planing hull 200. In this embodiment, the eight stringers 202 on each side of the centerline are spaced generally equidistantly on each side of the board. The upper panel (top deck) 204 is provided with a gentle convex curvature (inverted V) induced by the stringer installation as described above. Rails 206 are soft or pinched for hydrodynamic performance. The bottom panel (bottom deck) contains a predetermined rocker profile for surfing performance of various wave applications and rider skill levels. The tail 208 and nose 210 give this particular board a conventional egg design. Different tail and nose shapes are possible for different surfing applications.

Figure 12A:
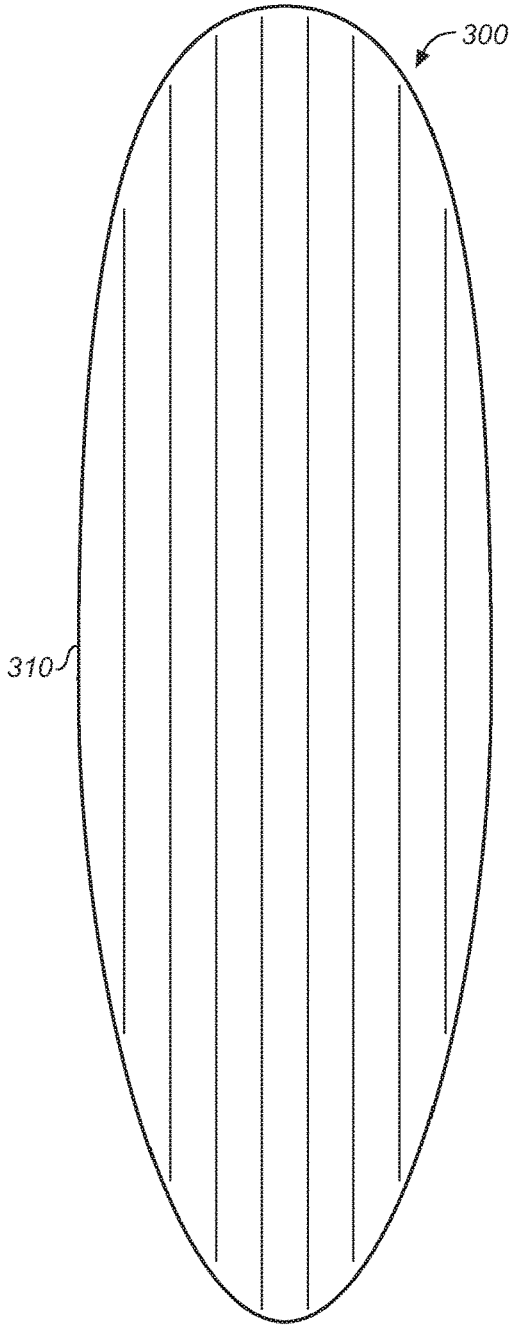
FIG. 12A is a top plan view of the inventive apparatus embodied in a beginner's surfboard (alternatively, a yoga board) having buoyancy rails.
Figure 12B:
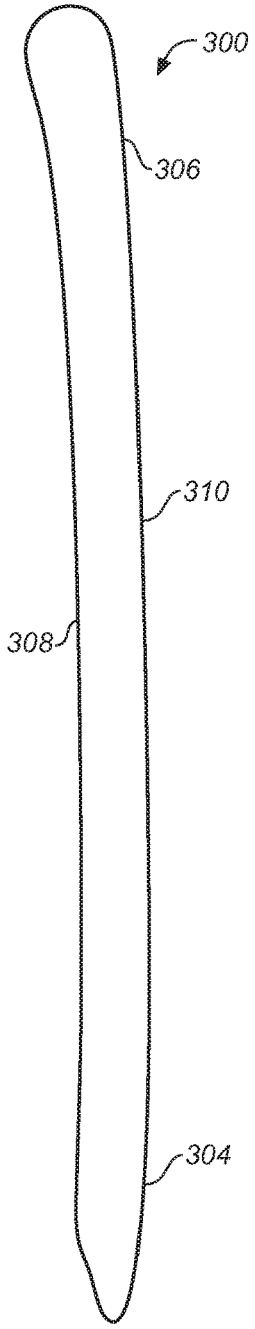
FIG. 12B is a side view in elevation thereof.
Figure 12C:
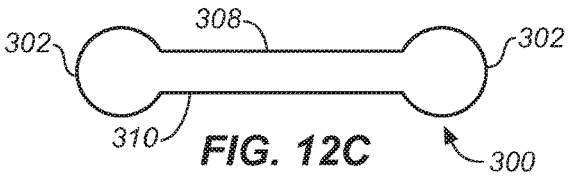
FIG. 12C is an end view in elevation thereof.

FIGS. 12A-12C show the inventive apparatus embodied in a beginner's surfboard (or yoga board) 300 having buoyancy rails. The additional stability provided by the buoyancy rails 302 enables a user to engage in yoga on the water. The stringer shapes employed in this board enable not only the cylindrical buoyancy rails but a gradual tail rocker 304 and a gradual nose rocker 306 for some maneuverability but high stability. The top panel 308 has a slight concavity to cradle the user on the top. The bottom side 310 may include continuous rocker and/or center rocker, or only nose and tail rocker, as shown.

Figure 13A:
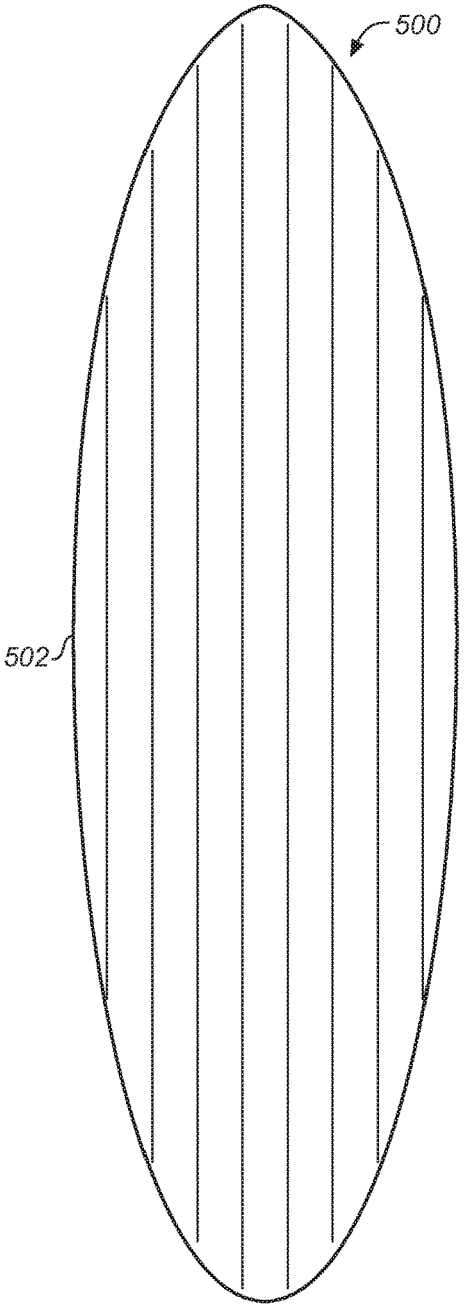
FIG. 13A is a top plan view of the inventive apparatus embodied in a performance racing paddleboard or distance ocean board with a displacement hull.
Figure 13B:
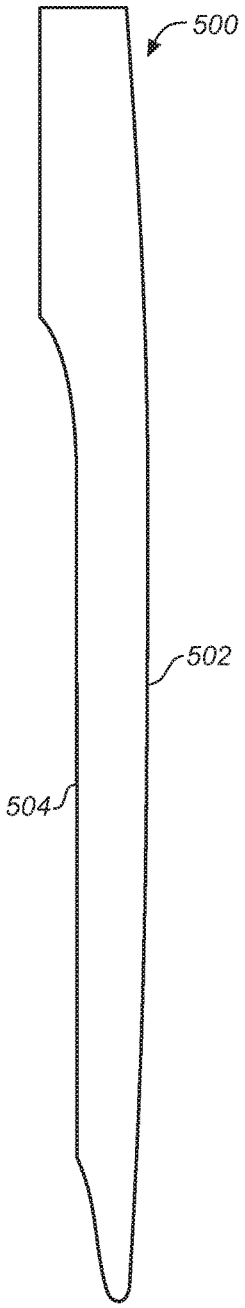
FIG. 13B is a side view in elevation thereof.
Figure 13C:
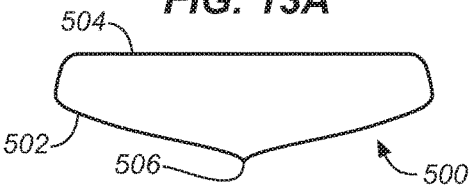
FIG. 13C is an end view in elevation thereof.

FIGS. 13A-13C show the inventive apparatus embodied in a performance racing paddleboard or distance ocean board 500 with a displacement hull having a V-shape bottom 502 and a generally flat top 504. In this embodiment, the lowest point of the board in the water 506 is along the longitudinal axis. In an alternative embodiment, longitudinal channels can also be included in the bottom contour to promote speed.

Figures 14A, 14B:
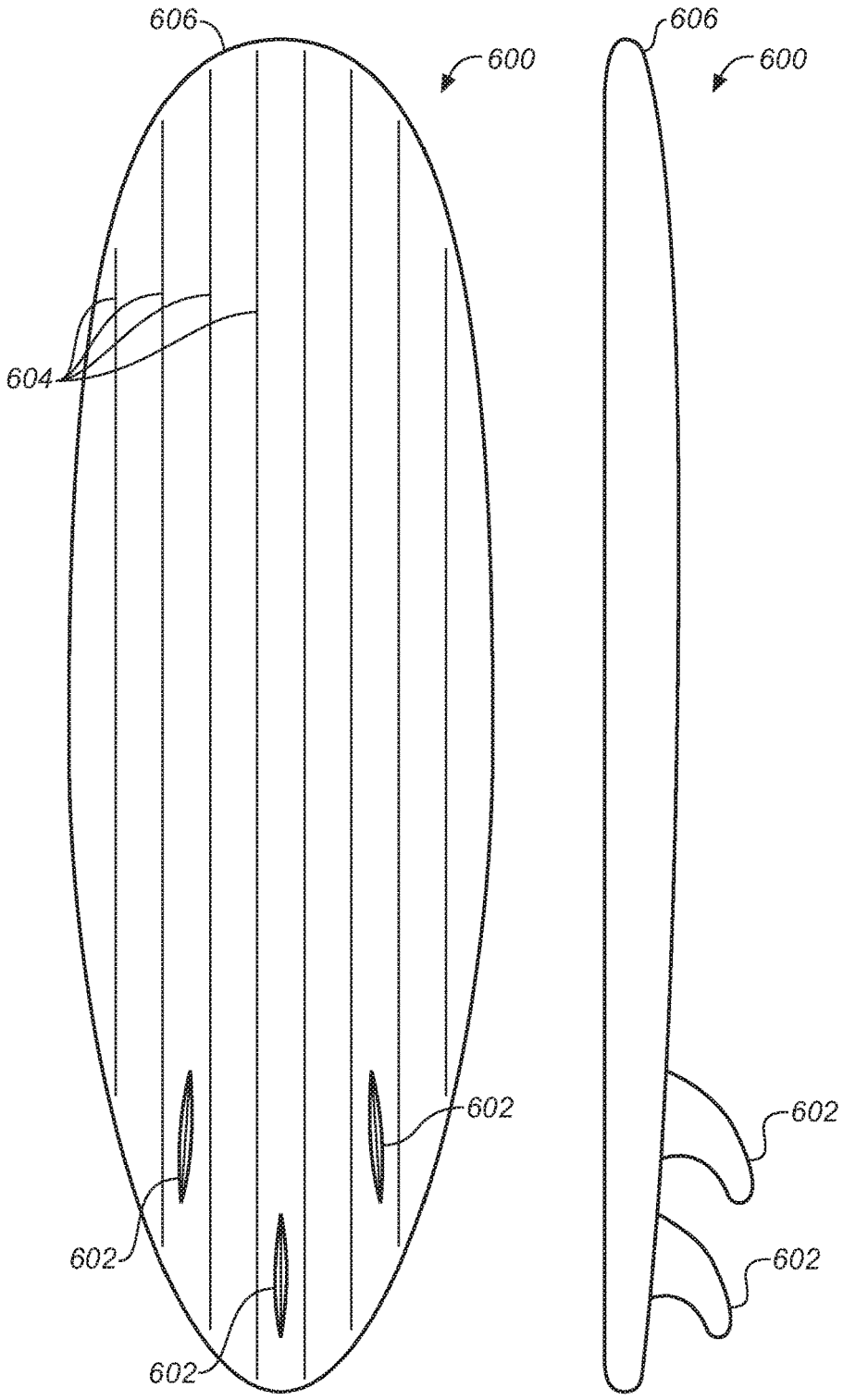
FIG. 14A is a bottom plan view of performance sports board of the present invention, the view showing a fin and stringer configuration made possible by the fin assembly employed in the present invention.
FIG. 14B is a side view in elevation thereof.
Figure 15A:
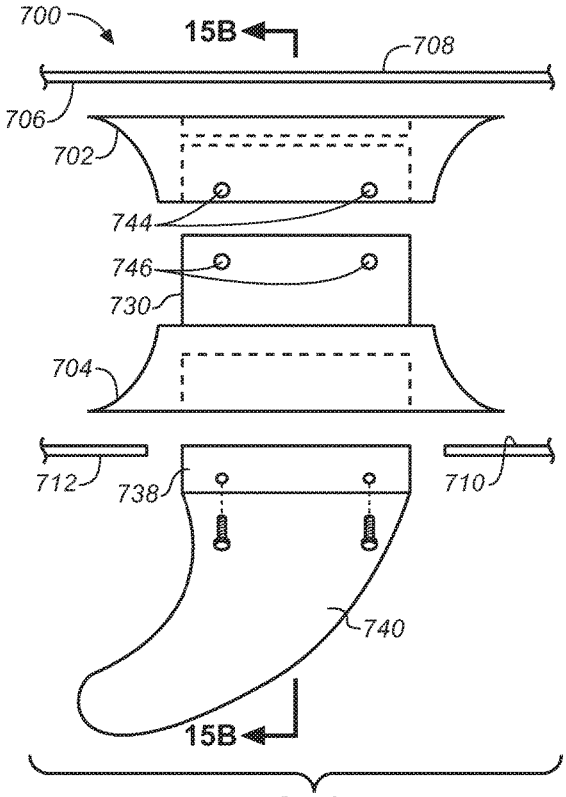
FIG. 15A is a schematic exploded side view in elevation showing the fin assembly of the present invention disposed between deck and bottom panels.
Figure 15B:
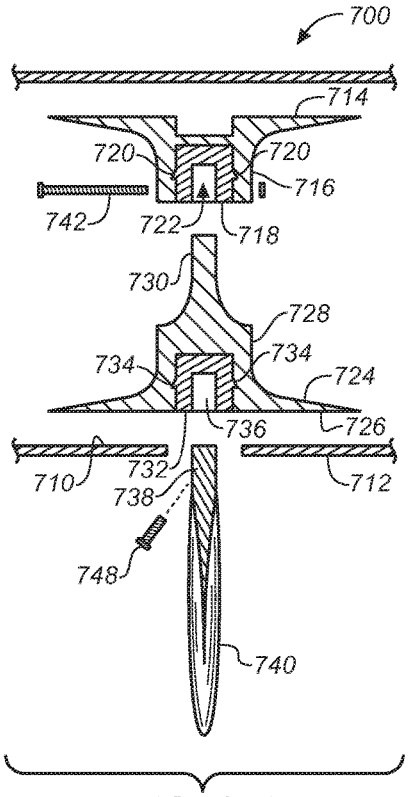
FIG. 15B is a cross-sectional end view in elevation thereof, taken along section lines 15B-15B of FIG. 15A.
Figure 16A:
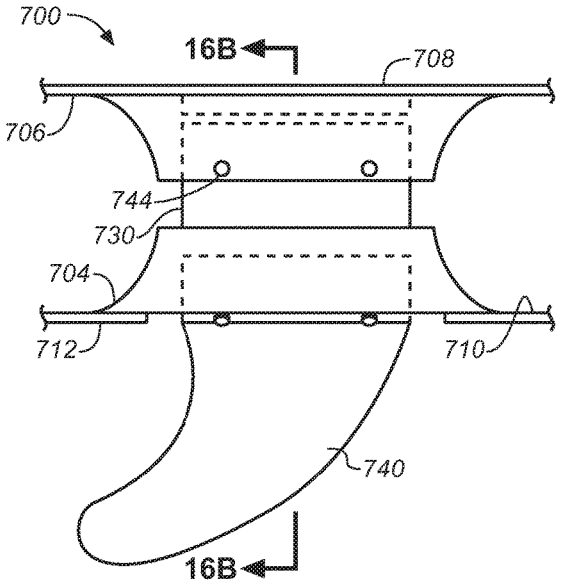
FIG. 16A is a side view in elevation showing the fin assembly installed and secured between the deck and bottom panels.
Figure 16B:
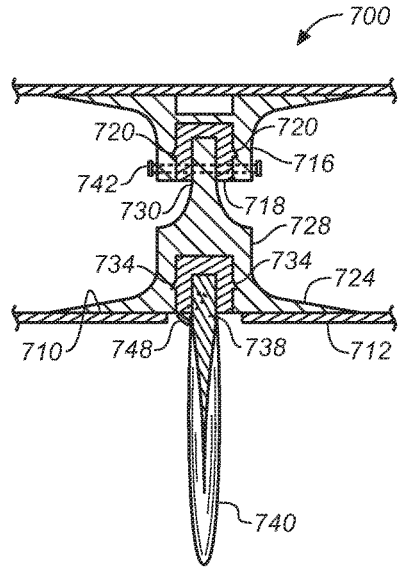
FIG. 16B is a cross-sectional end view in elevation thereof, taken along section lines 16B-16B of FIG. 16A.

FIGS. 14A-14B show a board 600 incorporating the fin assembly of the present invention, which assembly is made possible by the stringer system employed in the present invention. The fins (or skegs) 602 are placed between stringers 604 and can include any of a number of suitable depths, base lengths, rakes (sweeps), and orientations according to user preference and intended use. FIG. 14A shows a center fin and two side fins, the alignment dictated by longitudinal lines running through the length of the fin and converging at a point in the nose 606 of the board in a manner known in the art.

FIGS. 15A-16B show the components and placement of the fin assembly 700 employed in the present invention. It is a radical departure from any fin system known for inflatable boards and makes possible a rigid, high-performance fin system for inflatables. As will be appreciated from the views, the fin assembly includes a fin base anchor 702 and fin base 704, the former affixed/welded to the underside 706 of the deck panel 708, the latter affixed/welded to the upper side 710 of the bottom panel 712.

The fin base anchor includes a generally planar top side 714 and an integral anchor box 716. The anchor box is fabricated from a slightly resilient polymeric material that readily welds to the deck panel, and it may include a channel into which is disposed an interior anchor box 718 with surface features, such as barbs 720, which prevent the interior anchor box from being removed from the anchor box 716. The anchor box alone or interior anchor box includes a fin base channel or socket 722.

The fin base 704 includes a flexible foot 724 having a generally planar bottom side 726 which may be affixed/welded to the upper side 710 of bottom panel 712. Integral with the foot is a block portion 728 which tapers upwardly and then narrows into an elongate bar or male element 730 that fits tightly into the base anchor socket 722. Similarly to the base anchor, the base may include an interior fin box 732 also captured and retained in the block portion using surface features 734 and is formed to include a channel 736 for insertion of a fin base 738 of a fin 740. The male element is secured in the fin base anchor by passing bolts 742 through aligned fin base anchor holes 744 and fin base holes 746. The fin itself is secured in the fin box using grub screws 748.

From the foregoing, it will be appreciated that in an embodiment, and in a most essential aspect, the inventive inflatable structure is a hydrodynamically designed performance platform that includes: a first flexible material panel having an interior side, an exterior side, and a longitudinal axis; a second flexible material panel having an interior side, and exterior side, and a longitudinal axis; a plurality of internal stringers disposed between the first flexible material panel and the second flexible material panel, the internal stringers having an upper portion affixed to the interior side of the first flexible material panel, a lower portion affixed to the interior side of the second flexible material panel, and a medial portion defining a plane generally normal to the interior sides of the first and second flexible material panel, the internal stringers oriented generally parallel to the longitudinal axes of the first and second flexible material panels; wherein the internal stringers have a profile as seen in side view in elevation that defines the shape of the first flexible material panel and the second flexible material panel when the inflatable structure is assembled; the first and second flexible material panels joined at their edges to form a sealed interior volume; and a valve for selectively introducing pressurized air into and releasing air from the sealed interior volume.

It will be further appreciated that the essential inventive method for manufacturing and assembling an inflatable structure includes the following steps: laying out first and second flexible material panels; cutting the first and second flexible material panels to a shape suitable for the particular kind of inflatable structure under construction; marking the first and second flexible material panels for bonding; installing a valve reinforcement patch in the interior side of one of the first and second flexible material panels; cutting a valve hole in the flexible material panel at the valve reinforcement patch; installing a first set of stringer panels on the first flexible material panel; installing an opposing second set of stringer panels on the second flexible material panel such that when the first and second material panels are approximated in assembly, the first set of stinger panels overlap and engage stringer panels in the opposing second set of stringer panels; connecting the stringers on the first flexible material panel to their respective opposing stringers on the second flexible material panel; folding over a portion of the perimeter of the first flexible material panel and welding the folded portion to a perimeter of the second flexible material panel, leaving an end of the inflatable structure open; closing the open end by hand gluing or welding; installing an air fill valve in the valve hole; and inflating the inflatable structure by introducing air into the structure through the air valve.

Numerous sub-steps and variations on the essential steps may be undertaken either due to the particular kind of inflatable structure under construction or to customize or tailor the apparatus according to user preferences or use requirements.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, the number of stringers employed, forms, functions, operational features or the like.

Therefore, the above description and illustrations should not be construed as limiting the scope of the invention.

What is claimed as invention is:

1. An inflatable watercraft, comprising:

a first flexible panel having an interior side and an exterior side;

a second flexible panel having an interior side and an exterior side, said second flexible panel joined to said first flexible panel to form a sealed interior volume;

an air valve;

a first plurality of stringer panels each having a top portion and a bottom portion, said top portion attached to said interior side of said first flexible so as to impart deck contour to said first flexible panel and the bottom portion spaced away from the interior side of the second flexible panel; and a second plurality of stringer panels having a bottom portion attached to said interior side of said second flexible material panel and positioned in relation to said first plurality of stringer panels so as to form pairs of opposing stringers panels and so as to impart bottom rocker to said second flexible panel, wherein each stringer panel of said second plurality of stringer panels in an overlapped manner to the to a bottom portion of an opposing stringer panel in said first plurality of stringer panels said top portion of the second plurality of stringer panels spaced away from the interior side of said first flexible panel, wherein said stringers are oriented substantially parallel to the longitudinal axes of the first and second flexible panels, and, wherein the shape of said stringers and the connection between opposing stringers imparts contour to each of said first flexible panel and said second flexible panel when said inflatable watercraft is inflated.

2. The inflatable watercraft of claim 1 configured as a sports board.

3. The inflatable watercraft of claim 2, further including fins.

4. The inflatable watercraft of claim 3, wherein said fins are installed in fin base holes in said second flexible material panel.

5. The inflatable watercraft of claim 3, further including fin base anchors disposed on said interior side of said first flexible material panel.

6. The inflatable watercraft of claim 1, wherein said air valve is positioned in a rear portion of said first flexible material panel.

7. The inflatable watercraft of claim 1, wherein said stringers have a profile that defines a shape of both of said first flexible material panel and said second flexible material panel when the inflatable structure is assembled.

8. The inflatable watercraft of claim 7, wherein said first and second flexible material panels are joined at their edges.

9. The inflatable watercraft of claim 8, wherein said opposing stringer panels are overlapped and bonded to one another.

10. The inflatable watercraft of claim 8, wherein said opposing stringer panels are joined to one another using cordage lashings.

11. The inflatable watercraft of claim 10, wherein said air valve is configured to provide access to said interior volume so as to permit adjustment of lashing tension.

12. A method of manufacturing and assembling an inflatable watercraft, comprising:

laying out first and second flexible material panels;

cutting the first and second flexible material panels to a shape suitable for the particular kind of inflatable structure under construction;

marking the first and second flexible material panels for bonding;

installing a valve reinforcement patch in an interior side of one of the first and second flexible material panels;

cutting a valve hole in the flexible material panel at the valve reinforcement patch;

installing a first set of stringer panels on the first flexible material panel;

installing an opposing second set of stringer panels on the second flexible material panel such that when the first and second material panels are approximated in assembly, the first set of stinger panels overlap and engage stringer panels in the opposing second set of stringer panels;

connecting the first set of stringers to their respective opposing stringers in the second set of stringer;

wherein the first set of stringers have an upper portion affixed to the interior side of the first flexible material panel and a lower portion spaced away from the interior side of the second flexible material panel, and wherein the second set of stringers have, a lower portion affixed to the interior side of the second flexible material panel, and a top portion connected to the lower portion of the first set of stringers in an overlapped manner, said top portion spaced away from the interior side of the first flexible material panel, wherein said stringers have a medial portion defining a plane generally normal to the interior sides of the first and second flexible material panels, the internal stringers oriented generally parallel to the longitudinal axes of the first and second flexible material panels, and further wherein the stringers have a profile as seen in side view in elevation that defines the shape of the first flexible material panel and the second flexible material panel when the inflatable watercraft is assembled;

folding over a portion of the perimeter of the first flexible material panel and welding the folded portion to a perimeter of the second flexible material panel, leaving an end of the inflatable watercraft open;

closing the open end by hand gluing or welding;

installing an air fill valve in the valve hole; and inflating the inflatable watercraft by introducing air into the watercraft through the air valve.

13. The method of claim 12, wherein the inflatable watercraft is a sports board, and further including the step of cutting fin base holes in the second flexible material panel.

14. The method of claim 13, further including bonding fin base anchors to the interior side of the first flexible material panel.

15. The method of claim 14, further including bonding fin bases in the fin base holes.

16. The method of claim 12, wherein the opposing stringer panels are connecting using a lashing arrangement.

17. The method of claim 12, wherein the stringers in the first set of stringers are bonded to the interior side of the first flexible material panel and imparting deck contour to the first flexible material panel, and bonding lower portions of the second set of stringers to the interior side of the second flexible material panel to impart bottom rocker or bow/stern profile.

18. The method of claim 17, further including attaching lashing anchors to the interior side of the second flexible material panel adjacent the ends of the stringers at an end of the inflatable watercraft.

19. The method of claim 12, wherein the first and second sets of stringers are joined using welding or bonding.

20. The method of claim 19, further including coating the structure of the inflatable watercraft with a protective coating.

* * * * *